United States Patent [19]

Schleuchardt

[11] 4,335,651

[45] Jun. 22, 1982

[54] SETTING DEVICE FOR DENOMINATIONS IN FRANKING AND VALUE STAMPING MACHINES

[75] Inventor: Manfred Schleuchardt, Offenbach am Main, Fed. Rep. of Germany

[73] Assignee: Postalia GmbH, Offenbach am Main, Fed. Rep. of Germany

[21] Appl. No.: 176,047

[22] Filed: Aug. 7, 1980

[30] Foreign Application Priority Data

Aug. 7, 1979 [DE] Fed. Rep. of Germany ..... 2932424

[51] Int. Cl.[3] ..... B41J 1/60

[52] U.S. Cl. ..... 101/110; 101/77

[58] Field of Search ..... 101/110, 109, 106, 99, 101/95, 75, 77, 84–87

[56] References Cited

U.S. PATENT DOCUMENTS

| | | | |
|---|---|---|---|
| 230,441 | 7/1880 | Scholfield | 101/77 |
| 276,986 | 5/1883 | Ware | 101/85 |
| 694,682 | 3/1902 | Shoup | 101/77 |
| 1,500,424 | 7/1924 | Smith | 101/77 |
| 2,021,237 | 11/1935 | Phinney | 101/93.12 |
| 2,629,320 | 2/1953 | Baptist | 101/77 |
| 3,309,987 | 3/1967 | Pexton | 101/110 X |
| 3,461,797 | 8/1969 | Trab et al. | 101/91 X |
| 4,007,359 | 2/1977 | Ford | 101/91 |
| 4,207,814 | 7/1980 | Schenk | 101/76 |

*Primary Examiner*—E. H. Eickholt

*Attorney, Agent, or Firm*—Herbert L. Lerner; Laurence A. Greenberg

[57] ABSTRACT

Setting device for denominations in franking and value stamping machines, including a movable lever having edges being radially curved in a given mutual relationship, pins along which the radially curved edges are guidable, a non-rotatable control disc gear, first and second mutually engageable gears mounted on the lever, a fixed control cylinder, sprockets disposed on the fixed control cylinder, a printing cylinder, a gear being disposed on the printing cylinder and rotatable by the second gear, and a value printing numeral roll being disposed on the printing cylinder, movable by the printing cylinder gear and adjustable by the sprockets, the first gear being devolvable in steps defined by the given relationship on the fixed control cylinder and the non-rotatable control disc gear when the curved edges of the lever are guided along the pins for generating a planetary drive and thrust onto the second gear to set the denominations on the numeral roll.

7 Claims, 2 Drawing Figures

SETTING DEVICE FOR DENOMINATIONS IN FRANKING AND VALUE STAMPING MACHINES

Figure 1:
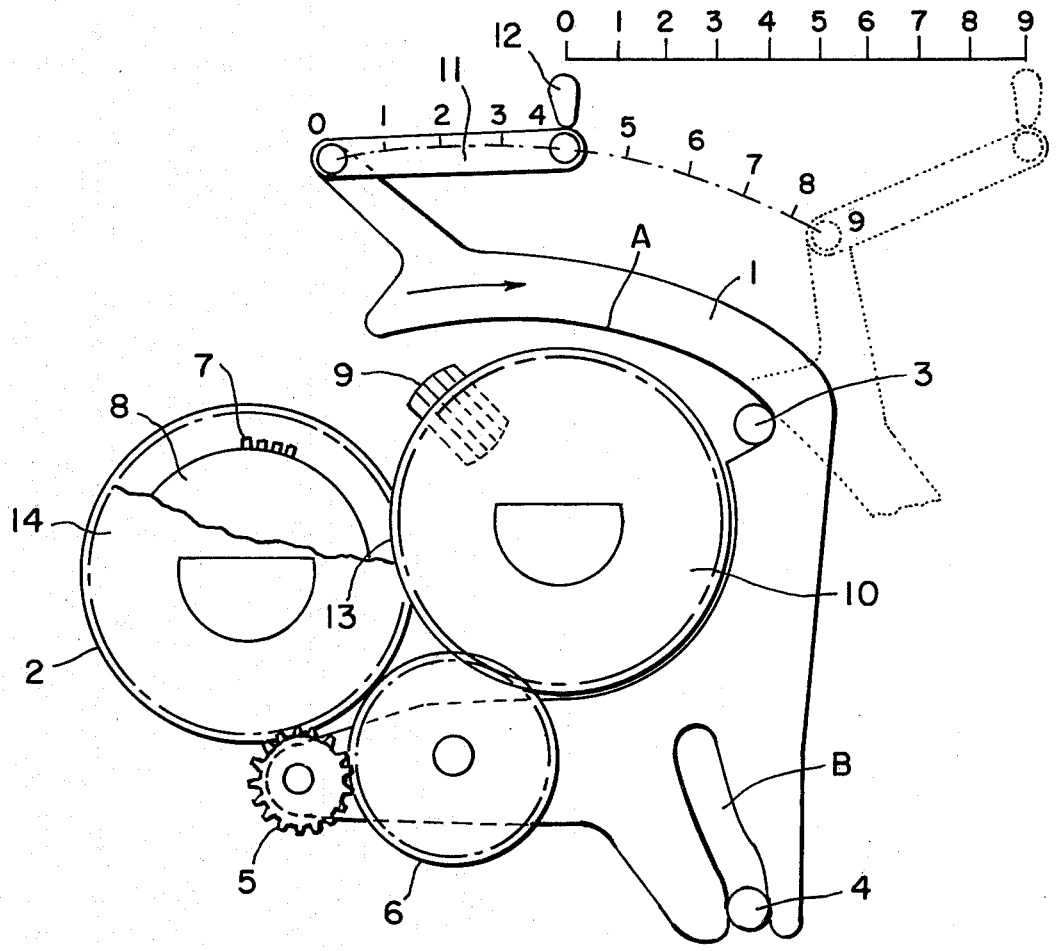

The invention relates to a setting device for printed denomination values in franking and value stamping machines.

Franking and value stamping machines require special devices for shifting a counting mechanism by the respective stamp value in addition to the printing device. For this purpose, a control cylinder with adjustable sprockets for controlling an adding or subtracting counter is used. The control cylinder and the cylinder printing the denomination are programmed simultaneously in parallel by a setting device. However, such devices are not as reliable as they should be and used many parts.

It is accordingly an object of the invention to provide a setting for denominations in franking and value stamping machines which overcomes the hereinafore-mentioned disadvantages of the heretofore-known devies of this general type, and which allows the highest possible reliability of the settings with a low parts count.

With the foregoing and other objects in view there is provided, in accordance with the invention, a setting device for denominations in franking and value stamping machines, comprising a movable lever having edges being radially curved in a given mutual relationship, pins along which the radially curved edges are guidable, a non-rotatable control disc gear, first and second mutually engageable gears mounted on the lever, a fixed control cylinder, sprockets disposed on the fixed control cylinder, a printing cylinder, a gear being disposed on the printing cylinder and rotatable by the second gear, and a value printing numeral roll being disposed on the printing cylinder, movable by the printing cylinder gear and adjustable by the sprockets, the first gear being devolvable in detent steps defined by the given relationship on the fixed control cylinder and the non-rotatable control disc gear when the curved edges of the lever are guided along the pins for generating a planetary drive and thrust onto the second gear to set the denominations on the numeral roll, i.e. the radii and angles of the radial curves are in a definite relationship to each other with regard to the detent step adjustment.

In accordance with another feature of the invention, up to one half of the first gear is toothless, i.e. is set free from part of the teeth up to one half the tooth width.

In accordance with a further feature of the invention, up to one half of the first gear is disengageable with the non rotatable control disc gear and the fixed control cylinder.

In accordance with an added feature of the invention, the given mutual relationship of the curved edges corresponds to curved paths obtained from the planetary movement and thrust.

In accordance with an additional feature of the invention, the non-rotatable control disc gear has a concave recess formed therein, the printing cylinder gear being at least partly engageable in the recess.

In accordance with again another feature of the invention, there is provided a sprocket guiding wheel disposed between the first gear and the sprockets.

In accordance with a concomitant feature of the invention, there is provided a link articulatable on said lever for describing a linear denomination reading.

Other features which are considered as characteristic for the invention are set forth in the appended claims.

Although the inventionis illustrated and described herein as embodied in a setting device for denominations in franking and value stamping machines, it is nevertheless not intended to be limited to the details shown, since various modifications and structural changes may be made therein without departing from the spirit of the invention and within the scope and range of equivalents of the claims.

Figure 2:
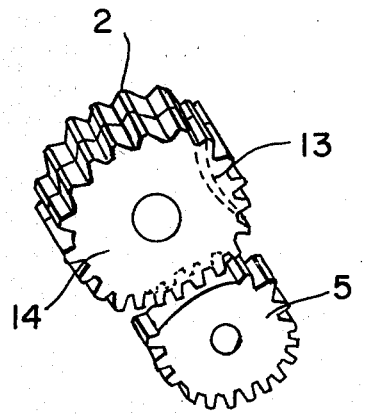

The construction and method of operation of the invention, however, together with additional objects and advantages thereof will be best understood from the following description of specific embodiments when read in connection with the accompanying drawings, in which:

FIG. 1 is a fragmentary diagrammatic elevational view partly broken away, of the setting device and its arrangement relative to the setting gear mechanism; and FIG. 2 is a diagrammatic perspective view of the tooth engagement of the gear of the setting lever with the control disc gear of the control cylinder.

Referring now to the figures of the drawing and first particularly to FIG. 1 thereof, it is seen that the setting device includes a lever 1 with an articulating link 11, an actuating member 12 and two gears 5,6 supported on pins provided at the lever 1. If the link 11 were not there, a projection at the point 0 would describe an arc in the direction toward the point 9 upon movement of the lever 1. On the other hand, the articulating support of the link 11 makes a linearly guided movement possible.

The lever 1 is guided on two pins 3, 4 and can be moved by means of the actuating member 12 in detent steps for the denomination settings 0 to 9. For exact guidance at the pins 3, 4, the shape of the lever 1 is fitted at the guiding edges for the pins to certain radial curves. The longer guiding curve A of the lever 1 corresponds to a certain curved path, as does the shorter curve B. The curves A, B are obtained mathematically from the composite planetary movement and the thrust motion. The curves A, B, in conjunction with the pins 3, 4, determine the motion of the gears 5, 6 in such a manner that the gear 5 moves on the partial circular track of a gear 2 and at the same time, the gear 6 moves on the partial circular track of a gear 10.

By shifting the lever 1, the gear 5 is moved. Since a control cylinder 8 is fixed and also since the control disc gear 2 is not rotatable, the gear 5 devolves on the control disc gear 2 and thus as it rolls on it generates a planetary drive and thrust movement onto the gear 6. The gear 6 in turn transmits the composite motion of the planetary drive and the thrust to the gear 10 of the printing cylinder which is to be adjusted. The denomination numeral printing rolls 9 are accordingly adjusted through a second gear drive which is not shown, and a rack.

A concave recess 13 of the control disc gear 2 prevents it from rotating relative to the gear 10 of the printing cylinder as best shown in FIG. 2. The gear 5 is toothless up to one half the tooth width thereof in order to ensure a setting of the denomination numeral rolls 9 in this manner. The sprockets 7 are moved out by a sprocket guiding wheel 14 through a cam. The wheel 14 is disposed on the same shaft as the control disc gear 2. The sprocket guiding wheel 14 is driven parallel to the gear 10 of the pringing cylinder by the gear 5. The part of the gear 5 which is provided with teeth all the way is in continuous engagement with the control disc gear 2.

When printing a denomination, the drive acts on the control disc gear 2, which thereby secures the set denomination value to be printed and for one revolution takes along the denomination printing numeral roll 9 of the printing cylinder, which is set to the same value. It is thereby ensured that during one printing revolution of the machine, neither a change of the value in the printing cylinder nor a shifting of the gear in the control cylinder is possible.

There are claimed:

1. Setting device for denominations in franking and value stamping machines, comprising a movable lever having edges being radially curved in a given mutual relationship, pins along which said radially curved edges are guidable, a non-rotatable control disc gear, first and second mutually engageable gears mounted on said lever, a fixed control cylinder, sprockets disposed on said fixed control cylinder, a printing cylinder, a gear being disposed on said printing cylinder and rotatable by said second gear, and a value printing numeral roll being disposed on said printing cylinder, movable by said printing cylinder gear and adjustable by said sprockets, said first gear being devolvable in steps defined by said given relationship on said fixed control cylinder and said non-rotatable control disc gear when said curved edges of said lever are guided along said pins for generating a planetary drive and thrust onto said second gear to set the denominations on said numeral roll.

2. Setting device according to claim 1, wherein up to one half of said first gear is toothless.

3. Setting device according to claim 1, wherein up to one half of said first gear is disengageable with said not rotatable control disc gear and said fixed control cylinder.

4. Setting device according to claim 1, wherein in said given mutual relationship of said curved edges cooresponds to curved paths obtained from the planetary movement and thrust.

5. Setting device according to claim 1, wherein said non-rotatable control disc gear has a concave recess formed therein, said printing cylinder gear being at least partly engageable in said recess.

6. Setting device according to claim 1, including a sprocket guiding wheel disposed between said first gear and said sprockets.

7. Setting device according to claim 1, including a link articulatable on said lever for describing a linear denomination reading.

* * * * *